United States Patent [19]

Law

[11] Patent Number: 4,796,762

[45] Date of Patent: Jan. 10, 1989

[54] STORAGE RACK

[76] Inventor: Donel G. Law, R.R. 1, Box 232B, Tipton, Ind. 46072

[21] Appl. No.: 65,842

[22] Filed: Jun. 24, 1987

[51] Int. Cl.[4] ..... A47F 7/00

[52] U.S. Cl. ..... 211/64; 211/70.8; 211/88; 211/89; 211/117

[58] Field of Search ..... 211/60.1, 70.8, 88, 211/64, 113, 117, 118, 89

[56] References Cited

U.S. PATENT DOCUMENTS

| | | | |
|---|---|---|---|
| D. 272,787 | 1/1984 | Rumbaugh . | |
| 1,837,939 | 12/1931 | Zimmerman . | |
| 2,535,564 | 12/1950 | Campbell . | |
| 2,577,713 | 12/1951 | Nogle . | |
| 2,797,033 | 6/1957 | Rasbach . | |
| 2,972,419 | 2/1961 | Zelen et al. | 211/113 X |
| 3,167,182 | 1/1965 | Calvin . | |
| 3,291,317 | 12/1966 | Bowen . | |
| 3,355,030 | 11/1967 | Cathcart | 211/117 X |
| 3,421,632 | 1/1969 | Wood | 211/70.8 |
| 3,558,090 | 1/1971 | Bird . | |
| 3,635,433 | 1/1972 | Anderson | 211/70.8 |
| 3,907,118 | 9/1975 | Pelavin . | |
| 4,003,612 | 1/1977 | Munsell | 211/70.8 X |
| 4,132,381 | 1/1979 | McClellan | 211/70.8 X |
| 4,387,873 | 6/1983 | Pavlo et al. | 211/113 X |

*Primary Examiner*—Robert W. Gibson, Jr.
*Attorney, Agent, or Firm*—Woodard, Emhardt, Naughton Moriarty & McNett

[57] ABSTRACT

The present invention provides a storage rack suitable for storing rifles, shotguns, fishing rods and the like. The present invention provides, in one embodiment, a fishing tackle box suspended below the storage rack. The rack may have a separate storage compartment therein. The invention also provides, in one embodiment, for the storage rack to be hung from hooks over the top of a door, and flexible suspension straps may be used to provide support. Gear, such as guns, may be held in place by velcro straps wrapped around the gun barrel. The storage rack of the present invention may include laterally projecting fishing rod holders for elongated fishing rods, as well as a holder for a protective fishing rod case.

24 Claims, 3 Drawing Sheets

STORAGE RACK

BACKGROUND OF THE INVENTION

This invention relates generally to storage racks, and more specifically storage racks suitable for storing elongated gear, such as rifles, shotguns, fishing rods, and the like.

Persons enjoying sporting activities such as hunting and fishing have a need for a convenient place to store their gear. It is desirable that such storage space be sturdy and reliable, and yet capable of being relocated when the need arises. It is also desirable to be able to store all of one's equipment in a single place.

U.S. Pat. Nos. 3,167,182 to Calvin, 2,797,033 to Rasbach and 2,535,564 to Campbell each disclose gun racks for horizontally storing guns behind the seat of an automobile, having hooks over the top of the seat. U.S. Pat. No. 3,291,317 to Bowen shows a horizontal gun rack with locking means and a storage compartment built in. U.S. Pat. No. 2,577,713 to Nogle shows a portable gun rack having pockets to receive a rifle for horizontal storage. The Nogle gun rack is designed to be hung from a nail or hook. U.S. Pat. Nos. 1,837,939 to Zimmerman and 3,558,090 to Bird disclose approaches to locking a gun barrel in place for storage. U.S. Pat. No. 3,907,118 to Pelavin shows a hangar adapted to be hooked over the top of doors. U.S. Pat. No. Des. 272,787 to Rumbaugh discloses a bracket for mounting on a wall for supporting the butt ends of vertically oriented fishing rods, commercially marketed with foam-lined recesses. The foregoing devices, while having advantages, do not provide the advantages of the present invention.

The present invention, in one embodiment, is suspended from flexible straps and hooks over the top of a standard doorway. This is advantageous in that the storage rack is portable and sturdy, and may, for example, be taken to a hunting or fishing lodge on a temporary basis. The present invention also provides, in one embodiment, a fishing tackle box suspended from it, thus providing a single storage place for one's fishing equipment. In addition to the fishing tackle box, a storage compartment is provided, suitable for storing ammunition, fishing reels or other items. The present invention also provides an improved means for holding gun barrels and/or fishing rods, utilizing a velcro strip wrapped therearound to hold the gear in place. Furthermore, an additional confinement strap may be provided. The present device also provides holders projecting laterally outward from the storage rack for holding long fishing rods which are too long to be otherwise stored. The present invention also provides, in one embodiment, a holder for receiving a telescoping fishing rod protection case. In addition to being hung from a door, the present invention also may be hung from a wall or other suitable means. The present invention, in one embodiment, also provides storage for both guns and fishing rods.

SUMMARY OF THE INVENTION

According to one embodiment, the present invention provides a storage rack for holding generally elongated gear having an upper and a lower end comprising a pair of generally vertical suspension members, a first support member at least partially suspended by the suspension members and adapted to receive the lower end of the gear to be stored, a second support member at least partially suspended by the suspension members and adapted to receive the upper end of the gear to be stored, and a fishing tackle box removably suspended below the generally vertical suspension members.

According to another embodiment, the present invention provides a storage rack for holding generally elongated gear having an upper and a lower end comprising a pair of generally vertical suspension members, a lower generally horizontal support member at least partially suspended by the suspension members and adapted to receive the lower end of the gear to be stored, upper means for holding the upper end of the gear, the means for holding generally positioned above the lower horizontal support member, and a pair of hooks coupled to a respective one of the pair of generally vertical suspension members, the pair of hooks being adapted to be hooked over the top of a door.

According to another embodiment, the present invention provides a storage rack for holding generally elongated gear having an upper and a lower end comprising a pair of generally vertical suspension members, a lower generally horizontal support member at least partially suspended by the suspension members and adapted to receive the lower end of the gear to be stored, upper means for holding the upper end of the gear, the means for holding generally positioned above the lower horizontal support member, and a first recess disposed in the upper means for holding and adapted to receive the upper end of the gear to be stored, wherein the first slot includes a velcro strap suitable to be wrapped around the upper end of the gear.

A general object of the present invention is to provide an improved storage rack.

These and other objects of the present invention are disclosed in the following description of the preferred embodiment.

DETAILED DESCRIPTION OF THE DRAWINGS

DESCRIPTION OF THE PREFERRED EMBODIMENT

Figure 1:
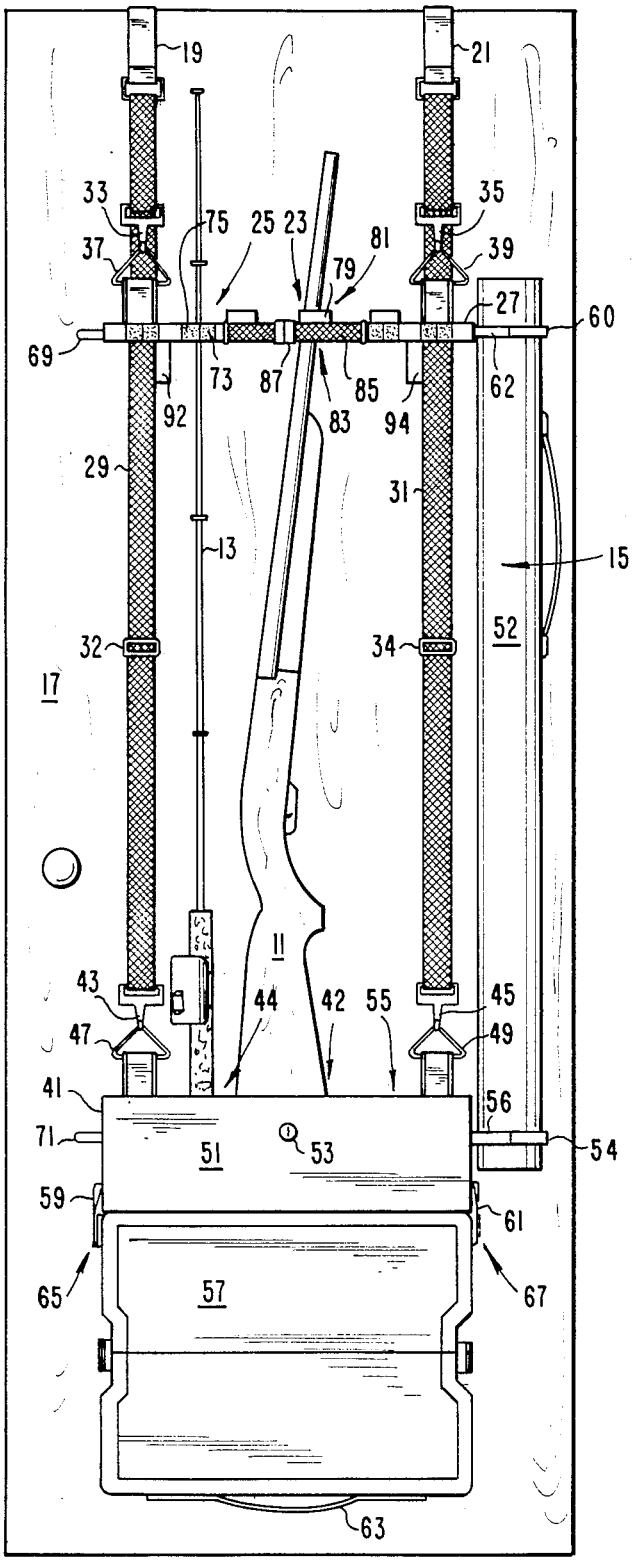
FIG. 1 shows a front view of the storage rack of the present invention hung on a standard door, storing a gun, a fishing rod, and a fishing rod case.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
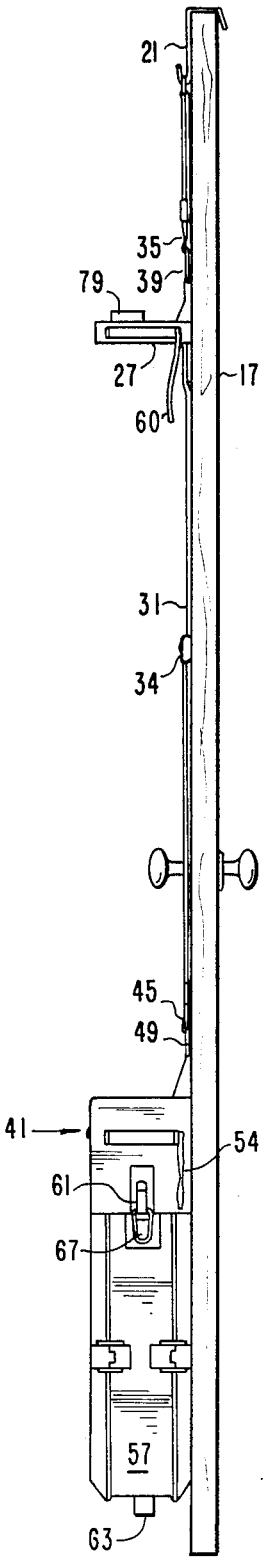
FIG. 2 shows a side view of the storage rack of FIG. 1 with the gun, fishing rod, and fishing rod case removed.

Referring now to FIGS. 1 and 2, gun 11 and fishing rod 13 are stored in storage rack 15 hung from the top of door 17 by hooks 19 and 21. The gun and fishing rod each have upper ends 23 and 25, respectively, which are held by upper support member 27, which in turn is suspended from and below hooks 19 and 21. Upper support member 27 is fastened to flexible web straps 29 and 31 which each form generally vertical suspension members hanging from the hooks. Upper support member 27 is connected to straps 29 and 31 by clips 33 and 35 and triangular loops 37 and 39.

Straps 29 and 31 also support lower support member 41 using clips 43 and 45 and triangular loops 47 and 49. Buckles 32 and 34 allow the respective straps 29 and 31 to be adjusted in length. The hooks and straps support, in tension, most of the weight of storage rack 15 as well as the gear being stored therein and thereon. The various clips 33, 35, 43 and 45 are readily detachable from their respective triangular loops 37, 39, 47 and 49 for dismantling the storage rack.

Lower support member 41 is generally horizontal and has door 51 on the front thereof with lock-latch 53 for securing the door closed. Behind door 51 is a storage compartment 58 (See FIG. 7) which is approximately 6"×6"×20" and is suitable for storing ammunition, fishing reels and other items. Lower member 41 also has a top surface 55 which is generally horizontal and may be flat, but in the best mode, has recesses therein for receiving gun butts and/or fishing rods.

Fishing tackle box 57 is removably suspended below lower member 41 by buckles 59 and 61. Fishing tackle box 57 is, in the best mode, a "Phantom" fishing tackle box (Model No. 1468) offered by Plano Molding Company of Plano, Ill. The fishing tackle box, as shown, is suspended such that handle 63 is directed downwardly. The tackle box, as shown, has been constructed with hooks 65 and 67 added thereto to receive the loop of the respective buckles.

In an alternative embodiment (not shown), not the best mode, small fishing tackle boxes may be used, such as ones offered by Plano Molding Company which have narrower widths. If such tackle boxes are used, a detachable hinge, having a male and female engaging dowel and partial cylinder may be used to couple the tackle box along the lower back edge of lower support member 41. A buckle or latch would be positioned below lock-latch 53 to hold the tackle box in place.

Gun 11 has lower end 42, and fishing rod 13 has lower end 44, each lower end being supported by lower member 41, which is adapted with recesses to receive such gear.

Upper support member 27 has rod holders, such as rod holder 69, which project laterally outward from upper member 27. There is a corresponding rod holder 71 which projects laterally outward from lower support member 41 and is generally below rod holder 69. Rod holder 69 and 71 collectively are adapted to receive a fishing rod therein, each having notches (See FIGS. 5A, 6A) which are pliable so that a rod may be snapped therein. Rod holders 69 and 71 provide a place to store long fishing rods which, if stored like fishing rod 13 in FIG. 1, would interfere with the movement of door 17 and possibly be damaged. Upper support member 27 and lower support member 41 are both generally rigid, typically being made of wood, metal, or molded plastic.

Telescoping protective fishing rod case 52 is held to lower support member 41 by yoke 56 velcro strap 54 and held to upper support member 27 by yoke 62 and velcro strap 60. These velcro straps are wrapped around telescoping rod case 52 to keep it snugly secured to the storage rack, ready to be removed therefrom for usage. Telescoping protective rod case 52 is a rod holder made by Plano Molding Company of Plano, Ill. (Model No. 3572) which consists of two annularly arranged cylinders which are adapted to be telescoped in a longitudinal manner, providing an elongated tube suitable for protective holding of fishing rods.

Figure 5A:
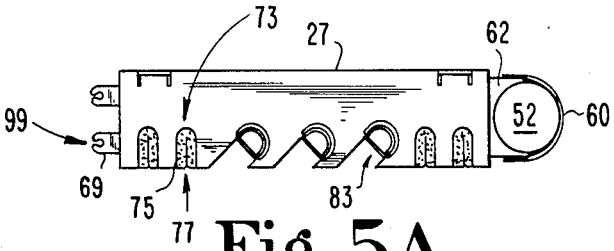
FIG. 5A is a top view of the upper support member of the storage rack of FIG. 1, having three gun barrel slots and four fishing rod slots.

Upper support member 27 also includes rod holders, such as rod holder 73, which comprises a U-shaped slot cut in member 27 lined with a corresponding U-shaped resilient foam liner 75. Resilient foam liner 75 has a slit 77 (See FIG. 5A) therein to snugly receive the upper end of fishing rod 13. Three other rod holders which are essentially the same as rod holder 73 are also shown in FIGS. 1 and 5A.

The upper end of gun 11 is held in upper support member 27 by velcro strap 79, which is fastened to hemi-cylindrical flange 81 projecting upwardly from member 27. Velcro strap 79 wraps around the outer circumference of flange 81 and around the gun barrel which is nested in gun slot 83 and flange 81 (See FIG. 8). Additionally, the gun barrel is confined by strap 85 which is located across the front face of upper support member 27, crossing the various gun slots, such as gun slot 83. Strap 85 has release buckle 87 which may be separated to slacken strap 85 for removal of a gun.

Figure 8:
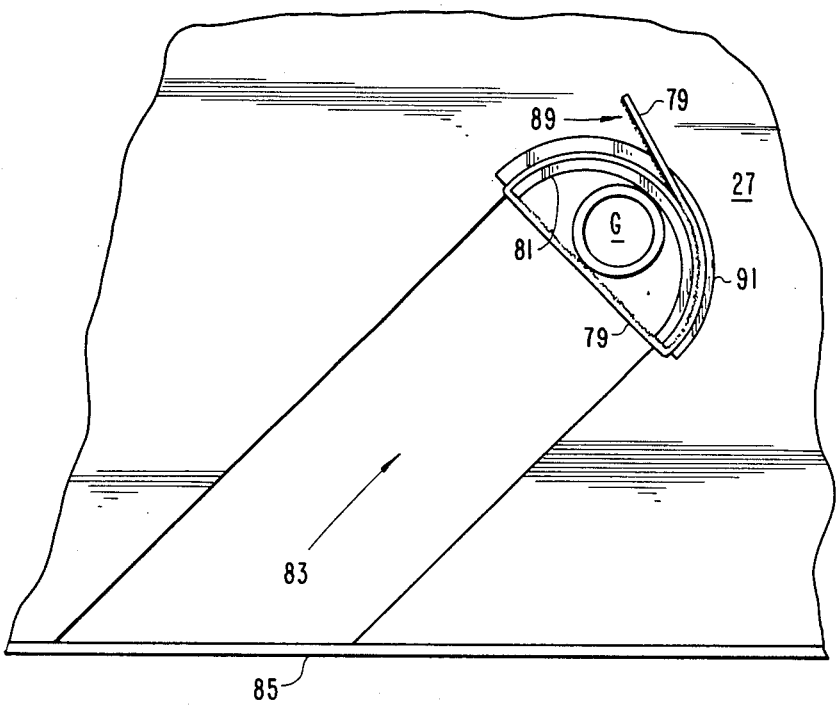
FIG. 8 is a detailed top view of a gun barrel slot of the storage rack of FIG. 1.

Referring now to FIG. 8, a detail of gun slot 83 and the corresponding structure is shown. As shown, strap 85 provides outer confinement while velcro strap 79 wraps around hemi-cylindrical flange 81 and holds the gun barrel designated as G. Note that velcro strap 79 has the fuzzy side 89 facing inwardly and the corresponding prickly side facing outwardly from flange 81. Also, molding 91 provides additional support for flange 81 around its outer circumference near the top surface of member 27.

Figure 3:
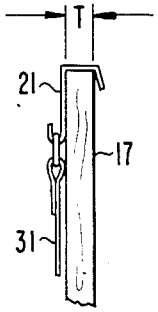
FIG. 3 shows an isolation side view of the hook of the storage rack of FIG. 1 hooked over a doorway having a thickness T.

Referring now to FIG. 3, an isolated side view of hook 21 is shown hooked over door 17. Thickness "T" of door 17 is that of a standard door, about $1\frac{3}{4}$" of which hook 21 has a corresponding hook reach of about $1\frac{3}{4}$". Although thickness "T" will vary with various door designs, the corresponding reach of hook 21 will not exceed 2½". Note, hook 21 is typically made of metal or a similar material of suitable strength.

Figure 4:
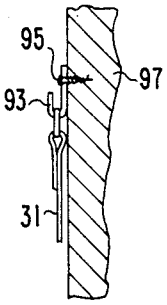
FIG. 4 shows an alternative to the hook shown in FIG. 3, FIG. 4 being a side view of a wall-mounted fitting from which the storage rack of the present invention may be suspended.

Referring now to FIG. 4, an alternative approach is shown in which hook 21 is replaced by wall fitting 93 which, like hook 21, has a small upward turned hook, but unlike hook 21 does not have the downward turned hook adapted to be hooked over a door frame. Instead, screw 95 is fastened into wall 97 to provide support for the storage rack.

Figure 5B:
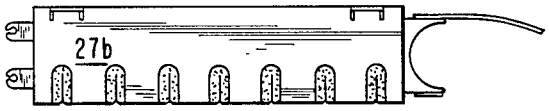
FIG. 5B is a top view of an alternative embodiment to the member of FIG. 5A, having seven fishing rod slots.
Figure 5C:
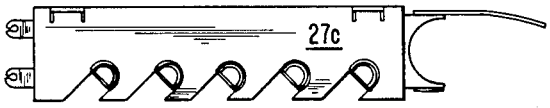
FIG. 5C is a top view of an alternative embodiment to the member of FIG. 5A, having five gun barrel slots.

Referring now to FIGS. 5A, 5B and 5C, various embodiments of the upper support member are shown. FIG. 5A shows the upper support member shown and described in FIG. 1. FIG. 5B shows an alternative upper support member **27*b* which is essentially the same as member 27, except that member 27*b* has seven rod holders, essentially the same as rod holder 73, and no gun slots, whereas member 27 has three gun holders as shown. Furthermore, FIG. 5C shows upper support member 27*c* which differs from member 27 in that support member 27*c* has five gun slots and no fishing rod holders, such as fishing rod holder 73. Note also, rod holder 69 includes notch 99 which is an expandable eyelet suitable to have a fishing rod snapped therein for holding. Also note that there is another such rod holder next to rod holder 69. Note that in FIGS. 5A, 5B, and 5C, straps, such as strap 85**, are not shown for drawing clarity.

Figure 6A:
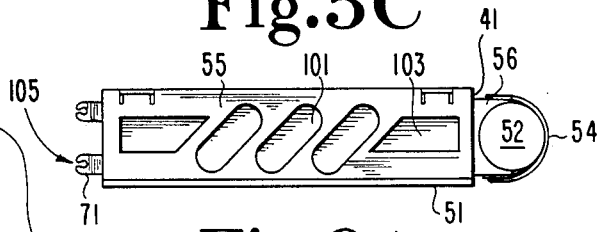
FIG. 6A is a top view of the lower support member of the storage rack of FIG. 1, having three oval gun butt recesses and two enlarged fishing rod recesses.
Figure 6B:
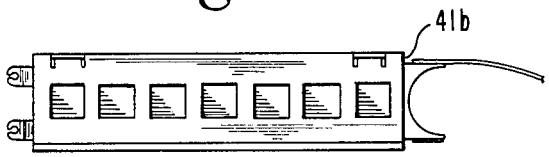
FIG. 6B is a top view of an alternative embodiment to the member of FIG. 6A, having seven fishing rod recesses.
Figure 6C:
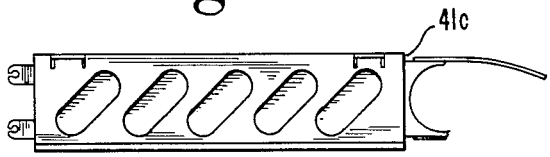
FIG. 6C is a top view of an alternative embodiment to the member of FIG. 6A, having five oval gun butt recesses.

Referring now to FIGS. 6A, 6B and 6C, top views of alternative embodiments of the bottom support member are shown. FIG. 6A shows bottom support member 41, substantially as shown in FIG. 1 and corresponding to upper support member 27 shown in FIG. 5A. Lower support member **41*b* shown in FIG. 6B corresponds to upper support member 27*b* shown in FIG. 5B, adapted to be used together to hold seven fishing rods, not including rods held in rod holders projecting laterally outward, such as rod holder 69. FIG. 6C shows lower support member 41*c* adapted to receive five gun butts, to be used with upper support member 27*c* shown in FIG. 5C. In FIG. 6A, note that there are three gun butt recesses, such as oval recess 101, which is suitably shaped to generally correspond to the shape of the gun butt, and may alternatively be generally elliptical in shape. Rod recesses, such as rod recess 103, are likewise recessed below top surface 55. These recesses provide lateral support to prevent the rods and/or guns from sliding out of the storage rack. Note that, like rod holder 69 in FIG. 5A, rod holder 71 in FIG. 6A includes a notch 105 suitable for receiving a fishing rod therein. Note that in FIGS. 5B, 5C, 6B and 6C, fishing rod case 52** is not shown, having been removed.

Figure 7:
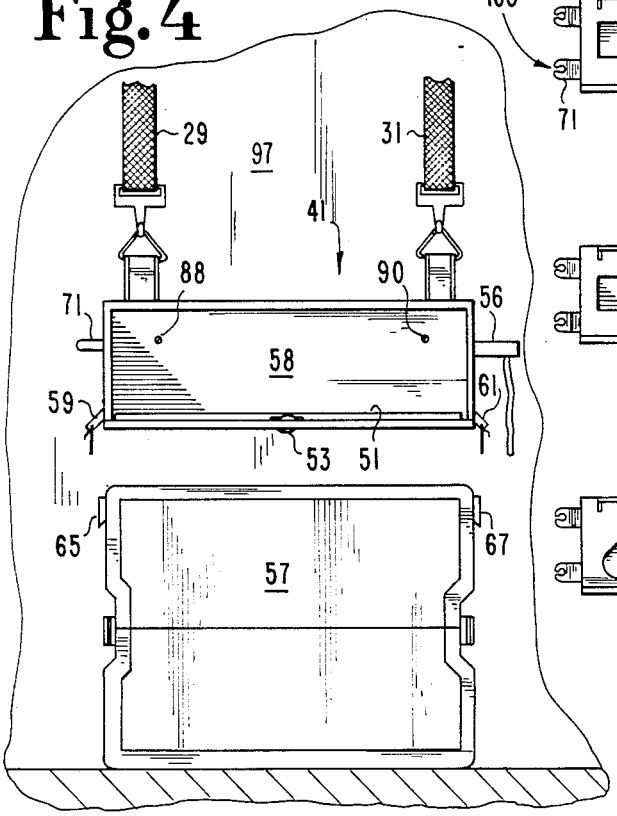
FIG. 7 is a partial front view of one embodiment of the present invention, showing the fishing tackle box separated from the lower support member of the storage rack.

Referring now to FIG. 7, fishing tackle box 57 is shown separated and removed from lower support member 41. Buckles 59 and 61 have been released from hooks 65 and 67, thus allowing tackle box 57 to be removed from the rest of the storage rack. Door 51 is shown in an open position revealing compartment 58. Also note that velcro strap 54 has been separated from yoke 56, with the telescoping protective fishing rod case 52 (as seen in FIG. 1) removed.

Note that screws 88 and 90 may be screwed into wall 97 (or a door) through the back wall of lower support member 41 to provide additional support and minimize rattling and banging of the storage rack. Similar such screws (not shown) may hold upper support member 27 to the door by placing such screws through holes in flanges 92 and 94 (See FIG. 1).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A storage rack for holding generally elongated gear having an upper and a lower end comprising:

a pair of generally vertical suspension members;

a first support member at least partially suspended by said suspension members and adapted to receive the lower end of the gear to be stored;

a second support member at least partially suspended by said suspension members and adapted to receive the upper end of the gear to be stored; and a fishing tackle box removably suspended below said generally vertical suspension members.

2. The rack of claim 1 and further comprising a pair of hooks coupled to a respective one of said pair of generally vertical suspension members, said pair of hooks being adapted to be hooked over the top of a door.

3. The rack of claim 2 wherein said generally vertical suspension members comprise flexible straps.

4. The rack of claim 3 wherein said second member includes a first slot adapted to receive the upper end of the gear to be stored, and wherein said first slot includes a velcro strap suitable to be wrapped around the upper end of the gear.

5. The rack of claim 4 wherein said first member includes a storage compartment therein and a compartment door openable to access said storage compartment.

6. The rack of claim 5 and further comprising means for confining the upper end of the gear, said means for confining attached to said second member.

7. The rack of claim 6 wherein said second member includes at least one rod holder suitable for receiving the upper end of a fishing rod.

8. The rack of claim 7 wherein said rod holder is lined with a resilient material, and wherein said first member includes both a recess disposed below said first slot and suitably sized for receiving a gun butt therein, and a fishing rod recess disposed below said resilient-material lined rod holder.

9. The rack of claim 8 and further comprising a lower means for holding rods projecting laterally outward from said first member, and an upper means for holding rods projecting laterally outward from said second member, said upper means for holding rods being positioned generally above said lower means for holding rods.

10. The rack of claim 9 and further comprising means for holding a fishing rod case being supported by said generally vertical suspension members.

11. The rack of claim 3 wherein said second member includes at least one resilient-material lined rod holder having a slit, said slit suitable for receiving the upper end of a fishing rod.

12. The rack of claim 3 and further comprising a lower means for holding rods projecting laterally outward from said first member, and an upper means for holding rods projecting laterally outward from said second member, said upper means for holding rods being positioned generally above said lower means for holding rods.

13. The rack of claim 1 wherein said generally vertical suspension members comprise flexible straps.

14. The rack of claim 1 wherein said second member includes a first slot adapted to receive the upper end of the gear to be stored, and wherein said first slot includes a velcro strap suitable to be wrapped around the upper end of the gear.

15. The rack of claim 1 wherein said second member includes at least one resilient-material lined rod holder having a slit, said slit suitable for receiving the upper end of a fishing rod.

16. The rack of claim 1 wherein said first member includes a storage compartment therein and a compartment door openable to access said storage compartment.

17. The rack of claim 1 and further comprising means for holding a fishing rod case being supported by said generally vertical suspension members.

18. A storage rack for holding generally elongated gear having an upper and a lower end comprising:

a pair of generally vertical suspension members;

a lower generally horizontal support member at least partially suspended by said suspension members and adapted to receive the lower end of the gear to be stored;

upper means for holding the upper end of the gear, said means for holding generally positioned above said lower horizontal support member; and a pair of hooks coupled to a respective one of said pair of generally vertical suspension members, said pair of hooks being adapted to be hooked over the top of a door, wherein said generally vertical suspension members comprise flexible straps, wherein said upper means for holding includes a first slot adapted to receive the upper end of the gear to be stored, and wherein said first slot includes a velcro strap suitable to be wrapped around the upper end of the gear.

19. A storage rack for holding generally elongated gear having an upper and a lower end comprising:

a pair of generally vertical suspension members;

a lower generally horizontal support member at least partially suspended by said suspension members and adapted to receive the lower end of the gear to be stored;

upper means for holding the upper end of the gear, said means for holding generally positioned above said lower horizontal support member; and a pair of hooks coupled to a respective one of said pair of generally vertical suspension members, said pair of hooks being adapted to be hooked over the top of a door, wherein said upper means for holding includes at least one resilient-material lined rod holder having a slit, said slit suitable for receiving the upper end of the gear.

20. A storage rack for holding generally elongated gear having an upper and a lower end comprising:

a pair of generally vertical suspension members;

a lower generally horizontal support member at least partially suspended by said suspension members and adapted to receive the lower end of the gear to be stored;

upper means for holding the upper end of the gear, said means for holding generally positioned above said lower horizontal support member; and a pair of hooks coupled to a respective one of said pair of generally vertical suspension members, said pair of hooks being adapted to be hooked over the top of a door, wherein said generally horizontal support member includes a storage compartment therein and a compartment door openable to access said storage compartment.

21. A storage rack for holding generally elongated gear having an upper and a lower end comprising:

a pair of generally vertical suspension members;

a lower generally horizontal support member at least partially suspended by said suspension members and adapted to receive the lower end of the gear to be stored;

upper means for holding the upper end of the gear, said means for holding generally positioned above said lower horizontal support member;

a pair of hooks coupled to a respective one of said pair of generally vertical suspension members, said pair of hooks being adapted to be hooked over the top of a door; and a lower means for holding rods projecting laterally outward from said lower generally horizontal support member, and an upper means for holding rods projecting laterally outward from said upper means for holding, said upper means for holding rods being positioned generally above said lower means for holding rods.

22. A storage rack for holding generally elongated gear having an upper and a lower end comprising:

a pair of generally vertical suspension members;

a lower generally horizontal support member at least partially suspended by said suspension members and adapted to receive the lower end of the gear to be stored;

upper means for holding the upper end of the gear, said means for holding generally positioned above said lower horizontal support member;

a pair of hooks coupled to a respective one of said pair of generally vertical suspension members, said pair of hooks being adapted to be hooked over the top of a door; and means for holding a fishing rod case being supported by said generally vertical suspension members.

23. A storage rack for holding generally elongated gear having an upper and a lower end comprising:

a pair of generally vertical suspension members:

a lower generally horizontal support member at least partially suspended by said suspension members and adapted to receive the lower end of the gear to be stored;

upper means for holding the upper end of the gear, said means for holding generally positioned above said lower horizontal support member; and a first slot disposed in said upper means for holding and adapted to receive the upper end of the gear to be stored, wherein said first slot includes a velcro strap suitable to be wrapped around the upper end of the gear.

24. The rack of claim 23 wherein said upper means for holding includes at least one resilient-material lined rod holder having a slit, said slit suitable for receiving the upper end of the gear, and wherein said generally horizontal support member includes both a recess disposed below said first recess and suitably sized for receiving a gun butt therein, and a fishing rod recess disposed below said resilient-material lined rod holder.

* * * * *